US008109009B1

(12) United States Patent
Collette et al.

(10) Patent No.: US 8,109,009 B1
(45) Date of Patent: Feb. 7, 2012

(54) AIR SEAL FOR ROTARY DRYER/KILN

(76) Inventors: Jerry R. Collette, Carrollton, OH (US); Warren E. Kelm, Malvern, OH (US)

( * ) Notice: Subject to any disclaimer, the term of this patent is extended or adjusted under 35 U.S.C. 154(b) by 393 days.

(21) Appl. No.: 12/459,658

(22) Filed: Jul. 6, 2009

Related U.S. Application Data

(60) Provisional application No. 61/133,866, filed on Jul. 3, 2008.

(51) Int. Cl.
*F26B 3/34* (2006.01)

(52) U.S. Cl. ..... 34/261; 34/242; 432/115; 432/108; 277/303; 277/590

(58) Field of Classification Search ..... 34/201, 34/203, 218, 242, 261, 210, 80, 90; 277/303, 277/590; 432/115, 108
See application file for complete search history.

(56) References Cited

U.S. PATENT DOCUMENTS

| | | | | |
|---|---|---|---|---|
| 5,106,105 | A | 4/1992 | Drexler | |
| 5,383,672 | A | 1/1995 | Cornelius | |
| 5,483,753 | A * | 1/1996 | Boivin et al. | 34/242 |
| 5,551,870 | A | 9/1996 | Gale | |
| 5,567,380 | A * | 10/1996 | Hoover | 266/173 |
| 5,571,269 | A | 11/1996 | Buelow | |
| 5,704,301 | A * | 1/1998 | Blasiole | 110/246 |
| 5,823,768 | A | 10/1998 | Blasiole et al. | |
| 6,003,874 | A | 12/1999 | Kuhn et al. | |
| 6,110,430 | A * | 8/2000 | Swisher et al. | 422/173 |
| 6,164,809 | A | 12/2000 | Hawkins | |
| 6,244,859 | B1 | 6/2001 | Ragailler | |
| 6,325,381 | B1 * | 12/2001 | von Engelbrechten | 277/361 |
| 6,418,637 | B1 | 7/2002 | Ahvenainen | |
| 6,464,493 | B2 * | 10/2002 | Polino et al. | 432/115 |
| 6,585,271 | B2 | 7/2003 | Divan | |
| 6,589,049 | B1 | 7/2003 | Sutton et al. | |
| 6,648,637 | B2 * | 11/2003 | Quigley | 432/242 |
| 6,685,465 | B2 | 2/2004 | Marquardt | |
| 6,893,256 | B2 | 5/2005 | Raichie et al. | |
| 7,686,612 | B1 * | 3/2010 | Buteau | 432/115 |
| 2003/0094762 | A1 | 5/2003 | Fuller | |
| 2007/0181465 | A1 * | 8/2007 | Collette | 208/400 |
| 2008/0093805 | A1 * | 4/2008 | Skorucak | 277/303 |

FOREIGN PATENT DOCUMENTS

| | | | |
|---|---|---|---|
| GB | 2315536 | A1 | 2/1998 |
| JP | 54101541 | A * | 8/1979 |
| JP | 54101545 | A * | 8/1979 |
| JP | 54101549 | A * | 8/1979 |
| JP | 11301455 | A * | 11/1999 |
| JP | 2000249476 | A | 9/2000 |
| JP | 2006078149 | A | 3/2006 |
| WO | WO 2007/007071 | A1 | 1/2007 |
| WO | WO 2010028513 | A1 * | 3/2010 |

* cited by examiner

*Primary Examiner* — Stephen M. Gravini
(74) *Attorney, Agent, or Firm* — James Creighton Wray

(57) ABSTRACT

A rotating drum in an oven is sealed against hot gas and air transfer. An annular outer seal holder has an L shaped cross section. A first end of the holder is connected to the oven. A second end is a radial flange. A backing plate has first and second sections. The first section has an inward extending guide. The second section has an inner diameter larger than an inner diameter of the guide portion. Bolts hold the backing plate and the seal retainer segments assembled on the flange. A cylindrical space between the radially guide portion of the backing plate and the seal retainer segments receives radially outwardly extending holder plates of segmental inner sealing elements. Partially cylindrical plates welded to the holder plates engage a drum wear plate. Leaf springs are connected to the seal retainer segments. Inner edges pressing the cylindrical plates radially inward.

19 Claims, 7 Drawing Sheets

AIR SEAL FOR ROTARY DRYER/KILN

This application claims the benefit of U.S. Provisional Application No. 61/133,866, filed Jul. 3, 2008, which is hereby incorporated by reference in its entirety.

SUMMARY OF THE INVENTION

The invention provides a unique rotary dryer, rotary kiln air seal to prevent fugitive air from entering a kiln or dryer at the feed and discharge breechings. The new seal is a steel contact seal comprised of formed radiused sections which ride on a wear plate affixed on the rotating drum. The seal utilizes a single floating labyrinth resistance, allowing for radial expansion of the drum and uneven drum surface contact. The seal sections are spring loaded with bent stainless steel spring clips. The seal is so designed as to accept maximum drum longitudinal expansion as well.

The seals may be used as kiln seals, kiln breeching seals, kiln air seals, kiln or dryer leaf seals, kiln carbon block seals, high temperature radial kiln seals, vacuum kiln seals or pressure kiln seals.

These and further and other features of the invention are apparent in the disclosure, which includes the above and ongoing written specification, with the claims and the drawings.

DETAILED DESCRIPTION OF THE PREFERRED EMBODIMENTS

Figure 2:
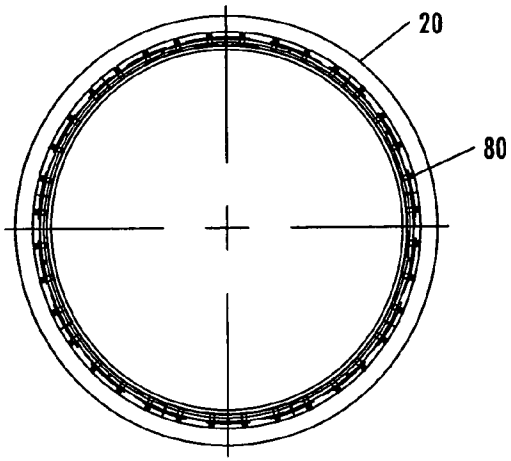
FIG. 2 is a front elevation of the seal assembly shown in FIG. 1.
Figure 3:
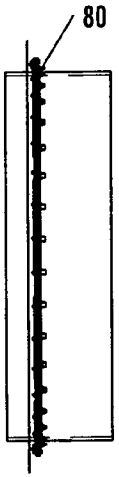
FIG. 3 is a side elevation of the seal assembly shown in FIGS. 1 and 2.
Figure 1:
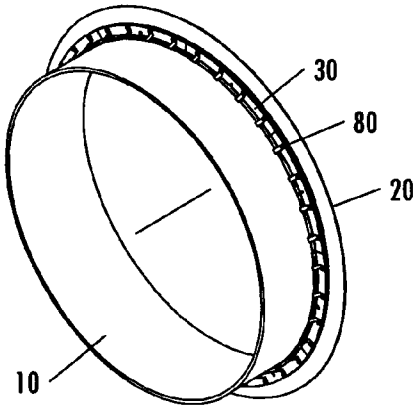
FIG. 1 is a perspective view of the oven primary seal assembly.

As shown in FIGS. 1-4, oven seal 30 is used to seal the opening clearance 22 between the oven structure 20 and the rotating drum 10 in which materials are heated. Only end portions of drum 10 and oven 20 are shown.

Figure 4:
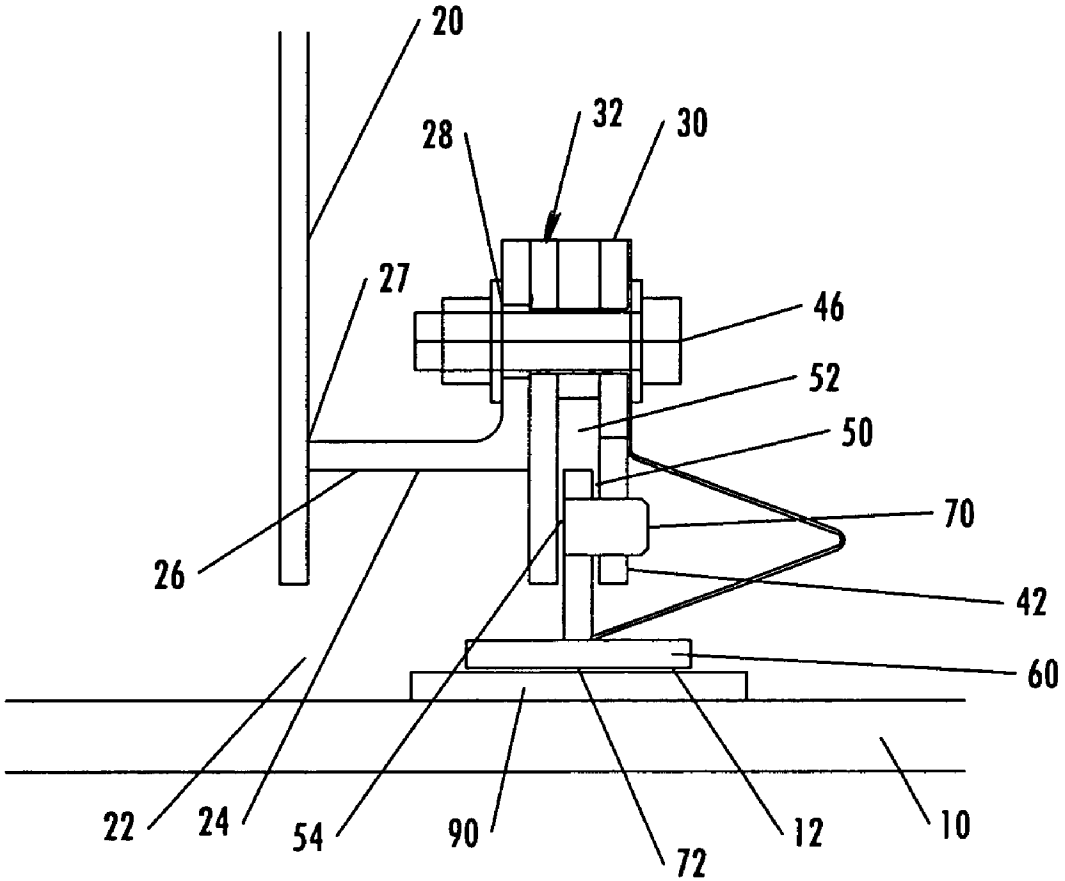
FIG. 4 is a sectional detail of the seal shown in FIGS. 1-3.

As shown in FIG. 4, the oven end structure 20 has an outer seal holder ring 24 with an L-shaped cross section. A cylindrical portion 26 is welded at an inner end 27 to the oven end structure 20. A circular flange 28 at the outer end of cylindrical portion 26 has openings for receiving bolts 46 to mount the seal 30.

Figure 8:
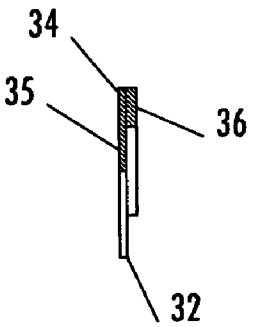
FIG. 8 is a cross sectional view of the seal backing plate weldment shown in FIG. 7.
Figure 7:
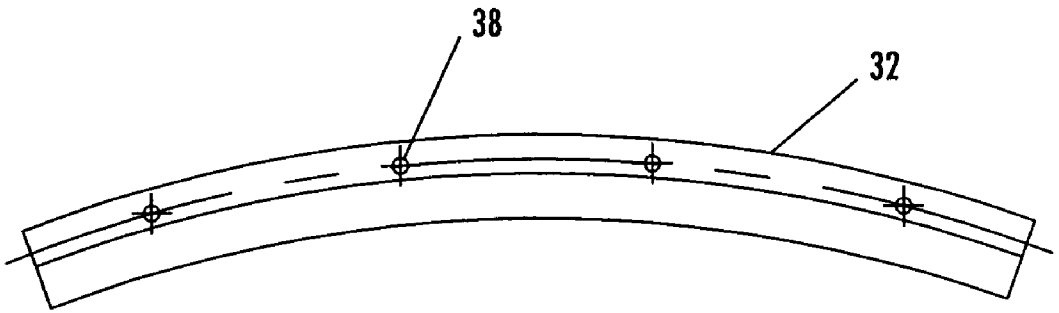
FIG. 7 is a front elevation of a seal backing plate weldment.

As shown in FIGS. 4, 7 and 8, an annular seal backing plate 32 is mounted against flange 28. The backing plate has two annular sections 34 and 36, which are welded together. Section 34 lies flat against the flange 28 and has a radially inward extended guide portion 35. Section 36, which has a larger inner diameter, is welded axially outwardly on section 34 to act as a spacer. Mounting bolt receiving holes 38 extend through both sections 34 and 36. The annular backing plate 32 may be constructed as one ring or as end to end segments.

Figure 9:
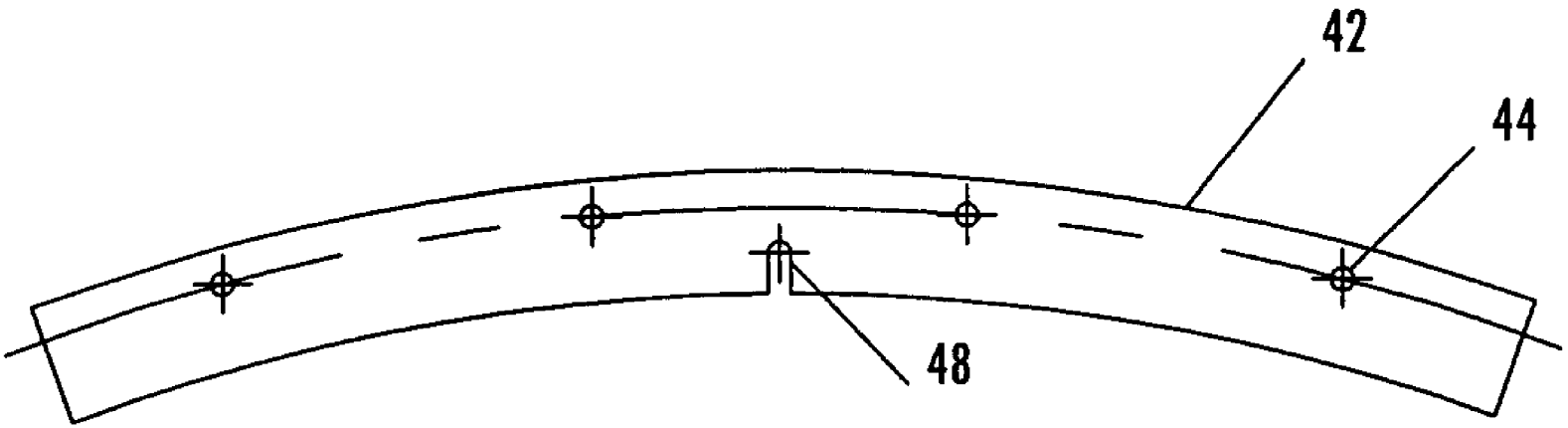
FIG. 9 is a side elevation of a seal retainer plate.
Figure 12:
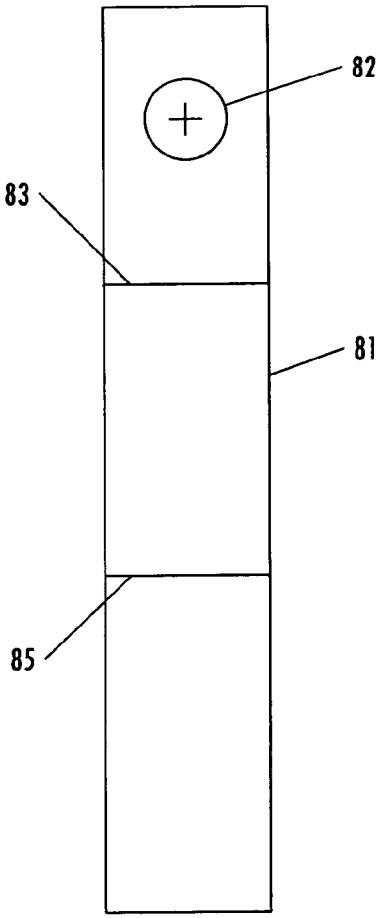
FIG. 12 is a front view of a blank for forming the seal spring shown in FIGS. 10 and 11.
Figure 11:
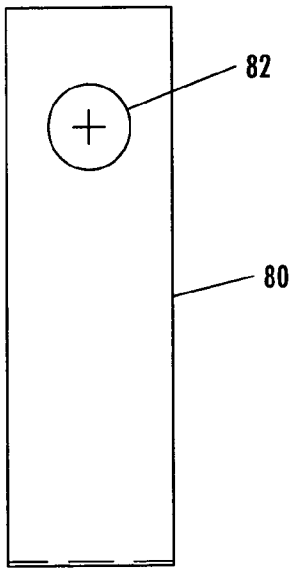
FIG. 11 is a front view of a seal spring shown in FIG. 10.
Figure 10:
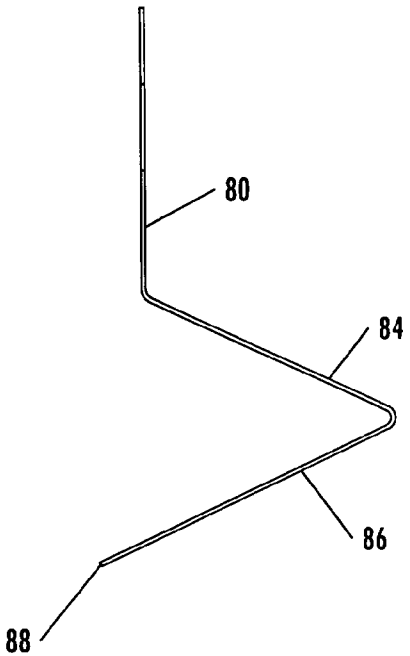
FIG. 10 is a side view of a seal spring.

As shown in FIGS. 4 and 9, an annular seal retainer 42 is formed in adjoined segments. Seal retainer 42 lies against the outer spacer section 36, which has the larger inner diameter. Bolt holes 44 in seal retainer 42 allow the seal retainer 42 to be connected with bolts 46 to the seal backing plate 32 and to flange 28 of oven seal holder ring. As shown in FIG. 4, a cylindrical space 50 remains between the radially inward extending portion 35 of the inner section 34 of seal backing plate 32 and the seal retainer 42. Space 50 provides a packing cavity 52 and a sealing elements receiver space 54.

Figure 6:
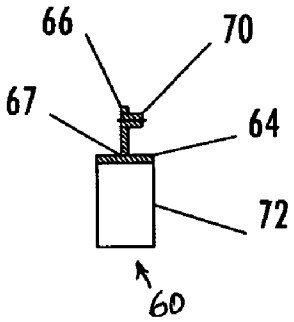
FIG. 6 is a cross sectional view of the seal section weldment shown in FIG. 5.
Figure 5:
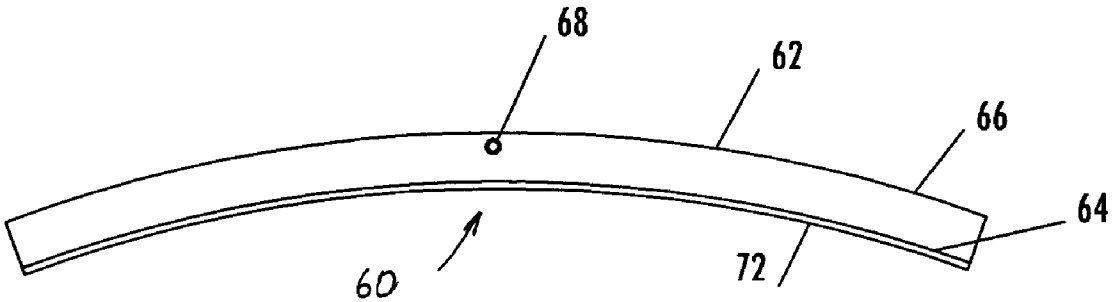
FIG. 5 is a front elevation of the seal section weldment.

As shown in FIGS. 4-6, sealing elements 60 are constructed in segmental sections 62. Partially cylindrical plates 64 are welded 67 to radially outward extending holder plates 66. The radial holder plates 66 have central openings 68 for receiving round bars 70, which slide radially in radial slots 48 in seal retainers 42, which are shown in FIG. 9. Bars 70 and grooves 48 prevent sealing elements, from rotating with the drum 10.

Figure 13:
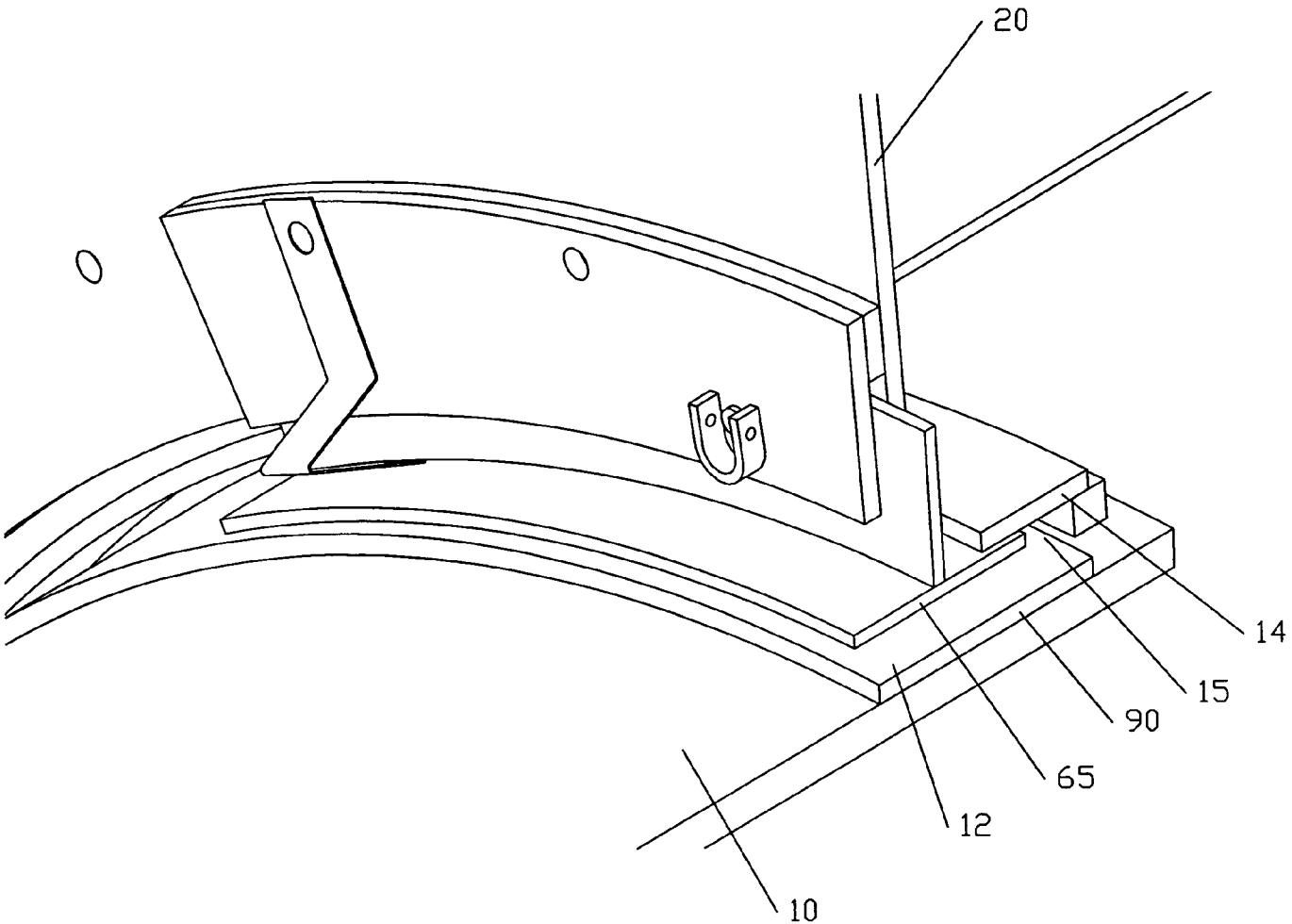
FIG. 13 is a perspective detail of the seal shown in FIGS. 1-12.

Inner cylindrical faces 72 of the sealing elements 60 ride on the outer surface 12 of an annular wear plate 90 on the drum 10 end, as shown in FIGS. 4 and 13, preventing ingress or egress of air, gas or vapor.

Packing material fills the packing space 52. The packing material may be resilient to keep faces 72 of the sealing elements 60 pressed against the outer surface 12 of the annular wear plate 90 on the drum 10.

Springs 80, as shown in FIGS. 1-4 and 10-12, are connected by bolts 46 to lie against the seal retainers 42 and press the sealing elements 60 and their inner surfaces 72 against the outer surface 12 of drum 10 or a wear plate 90 on the drum.

Springs 80 are made from flat blanks 81. Holes 82 are lanced to receiving mounting bolts 46. The blanks are bent up 65° at line 83 and down 130° at line 85 to form outer and inner leg sections 84 and 86. The inner edges 88 of inner sections 86 bear against an outer surface of plates 64 of sealing elements 60 to urge the inner faces 72 towards the wear plate 90 and drum 10.

The inner leg sections 86 of the springs 80 are longer than the outer leg sections 84. The spring inner edges 88 engage welded intersections 67 between the radial holder section 66 and the axially extending curved plates 64. That tends to keep the sealing elements aligned in the radial spaces 50, with the inner faces 72 of the sealing elements 60 firmly against the outer surface 12 of the drum 10 or the wear plate 90 on the drum as the drum rotates and also as drum ends and oven ends move relatively longitudinally during temperature variations.

Actions of the spring 80 are shown in FIG. 13. FIG. 13 also shows a receiver 14 welded on the outer surface of the drum.

Lateral portions 65 of the curved sealing plates 64 fit in recess 15 of the receiver 14, providing a secondary rotary seal between the drum 10 and the oven structure 20.

The invention provides new air seals including new air seal 30 for a rotary dryer/kiln designed to prevent air from entering the dryer or kiln at either the feed or discharge openings. The new seal is a steel contact device comprised of formed radius sections 64. Inner faces 72 of the sections 64 ride on an outer surface 12 of a wear plate 90 secured to the rotating drum 10. The new seal 30 uses a single floating labyrinth resistance closure. This type of closure allows for radial expansion of the drum 10 and uneven drum surface contact.

The seal sections 60 are spring loaded with bent stainless steel spring clips 80. The seal also accommodates drum longitudinal expansion as well.

The seals 30 may be used as kiln seals, kiln breeching seals, kiln air seals, kiln or dryer leaf seals, kiln carbon block seals, high temperature radial kiln seals, vacuum kiln seals, pressure kiln seals.

While the invention has been described with reference to specific embodiments, modifications and variations of the invention may be constructed without departing from the scope of the invention, which is defined in the following claims.

We claim:

1. Seal apparatus comprising a rotatable cylinder, a housing spaced radially outward from the cylinder, an annular outer seal holder having an L shaped cross section, a cylindrical first section of the annular holder being axially extending and concentric with the cylinder and having first and second axial ends, the first end connected to the housing, a second section of the holder further comprising an annular radially extending flange connected to the second end of the cylindrical first section, an annular backing plate mounted on the flange, the backing plate having first and second annular sections, the first annular section of the backing plate having a radially inward extending guide portion, the second annular section of the backing plate having an inner diameter larger than an inner diameter of the guide portion, adjoined annular seal retainer segments connected to the second annular section of the backing plate, the radially extending flange, the first and second sections of the backing plate and the seal retainer segments having aligned bolt receiving holes, bolts extending through aligned bolt receiving holes, holding the first and second sections of the backing plate and the seal retainer segments assembled, a cylindrical space between the radially inward extending guide portion of the backing plate and the seal retainer segments, sealing elements further comprising segmental sections, the segmental sections having radially outwardly extending holder plates positioned in the cylindrical space, and axially retained between the radially inward extending guide portion of the backing plate and the seal retainer segments, the segmental sections of the sealing elements further comprising partially cylindrical plates welded to the radially extending holder plates and engaging the cylinder or a wear plate on the cylinder and sealing against movement of gas between opposite axial sides of the seal apparatus.

2. The apparatus of claim 1, wherein the cylinder is a relatively rotating drum, the housing is an oven and the seal apparatus seals an outside of the drum in the oven.

3. The apparatus of claim 1, wherein the second annular section of the annular backing plate is welded to the first annular section of the annular backing plate.

4. The apparatus of claim 1, wherein the first end of the cylindrical section of the outer seal holder is welded to the housing.

5. The apparatus of claim 1, wherein the cylindrical space between the radially inward extending guide portion of the backing plate and the seal retainer segments, has a packing space between the second annular section of the backing plate and outward extensions of the radially outwardly extending holder plates for receiving packing material.

6. The apparatus of claim 1, further comprising a wear plate on the cylinder for engaging the partially cylindrical plates of the sealing elements segmental sections.

7. The apparatus of claim 1, wherein the radially outwardly extending holder plates of the sealing elements segmental sections have axially extending bars and the annular seal retainer segments have inward opening radially extending grooves for receiving the bars and preventing rotation of the sealing elements with the cylinder.

8. The apparatus of claim 1, further comprising springs connected between the seal retainer segments and the sealing elements and urging the cylindrical plates of the sealing elements into contact with the cylinder or the wear plate on the cylinder.

9. The apparatus of claim 8, wherein the springs are leaf springs having outer ends connected to the seal retainer segments and having inner ends pressing the cylindrical plates radially inward.

10. The apparatus of claim 9, wherein inner edges of the inner ends of the leaf springs contact intersections of the cylindrical plates with the holder plates.

11. Rotary seal apparatus, comprising:

a rotating drum, a stationary housing surrounding at least an axial part of the drum, a seal holder connected to the housing, the seal holder further comprising an annular backing plate and a retainer, the annular backing plate connected to the housing and having first and second sections connected together, the first section of the annular backing plate having a guide portion extending inward toward the drum, having an inner circumference spaced from the drum and having an inner diameter larger than an outer diameter of the drum, the second section of the annular backing plate having an inner circumference and inner radius larger than those of the first section, a retainer connected to the second section of the annular backing plate, a cylindrical space between the guide portion and the retainer, a seal having a radially outward extending holder mounted in the cylindrical space and having cylindrical inner surfaces in contact with the rotating drum.

12. The apparatus of claim 11, further comprising springs connected to the seal holder and the seal for urging the seal toward the rotating drum.

13. The apparatus of claim 11, wherein the seal comprises sealing elements further comprising segmental sections, the outward extending holder comprises having radially outwardly extending holder plates positioned in the cylindrical space.

14. The apparatus of claim 13, wherein the segmental sections of the sealing elements further comprising partially cylindrical plates welded to the radially extending holder plates and engaging the cylinder or a wear plate on the cylinder and sealing against movement of gas between opposite axial sides of the seal apparatus.

15. The apparatus of claim 13, wherein the radially outwardly extending holder plates of the sealing elements segmental sections have axially extending bars and the annular seal retainer segments have inward opening radially extending grooves for receiving the bars and preventing rotation of the sealing elements with the rotating drum.

16. The apparatus of claim 14, further comprising leaf springs having outer ends connected to the seal retainer segments and having inner ends pressing the cylindrical plates radially inward.

17. The method of sealing an oven and a rotating drum, comprising:

providing an oven, providing a drum within the oven, rotating the drum, providing a seal holder on the oven, providing seal retainer segments on the seal holder, providing a cylindrical space between the seal retainer segments and the holder, providing sealing elements with segmental sections having radially extending holder plates and partially cylindrical sealing plates welded to the holder plates, inserting the holder plates in the space, connecting the seal retain segments to the seal holder, entrapping the sealing elements, providing springs between the retain segments and the sealing plates, and urging the sealing plates toward the drum.

18. The method of claim 17, the providing springs further comprising providing leaf springs having outer ends connected to the retainer segments and having inner edges contacting intersections between the holder plates and the partially cylindrical plates.

19. The method of claim 17, further comprising providing a packing space in an outer portion of the cylindrical space.

* * * * *